US005087090A

United States Patent [19]

Humphrey et al.

[11] Patent Number: 5,087,090

[45] Date of Patent: Feb. 11, 1992

[54] COMBINATION LOCKOUT/HOLDBACK APPARATUS

[75] Inventors: Edward F. Humphrey, Waterbury; Nelson J. De Angelo; David W. Florian, both of Southington, all of Conn.

[73] Assignee: International Security Products, Inc., Southington, Conn.

[21] Appl. No.: 702,784

[22] Filed: May 17, 1991

[51] Int. Cl.[5] ..... E05C 1/04

[52] U.S. Cl. ..... 292/359; 292/150; 70/360

[58] Field of Search ..... 292/150, 359, DIG. 27, 292/DIG. 24, 336.3; 70/360

[56] References Cited

U.S. PATENT DOCUMENTS

| | | | |
|---|---|---|---|
| 2,435,634 | 2/1948 | Nicolin et al. | 292/150 X |
| 2,644,704 | 7/1953 | Hagstrom | 292/359 |
| 3,473,356 | 10/1969 | Niilola | 70/360 |

*Primary Examiner*—Richard E. Moore

*Attorney, Agent, or Firm*—Chilton, Alix & Van Kirk

[57] ABSTRACT

An inside operator for a lock having a spring biased bolt includes a shaft which can be immobilized, thus preventing longitudinal bolt motion, by applying force in the axial direction to the handle of the operator. The operator shaft is telescopic to ensure that the coupling of the operator shaft to the bolt is not interrupted as the operator is switched between operational modes.

9 Claims, 7 Drawing Sheets

COMBINATION LOCKOUT/HOLDBACK APPARATUS

BACKGROUND OF THE INVENTION

1. Field of the Invention

The present invention relates to security devices and particularly to apparatus for selectively capturing a spring biased bolt in the retracted position and/or preventing withdrawal of such a bolt from the extended locked position by rendering a manual bolt actuator inoperative. More specifically, this invention is directed to an inside operator for an automatically extendable bolt, a deadbolt for example, which can function in either a holdback or lockout mode respectively to prevent automatic bolt extension upon door closure or prevent use of an outside operator to cause retraction of an extended bolt. Accordingly, the general objects of the present invention are to provide novel and improved apparatus of such character.

2. Description of the Prior Art

While not limited thereto in its utility, the present invention is particularly well suited for employment as the inside operator of an automatic deadbolt type lock such as disclosed in co-pending U.S. patent application Ser. No. 560,423, now U.S. Pat. No. 5,058,940, issued Oct. 22, 1991. There are circumstances when convenience dictates that an automatic deadbolt, or other type of spring biased bolt, be disabled so that the bolt does not move to the fully extended and locked position upon closure of a door having mounted thereon the security device which includes the bolt. The selective and temporary disablement of an automatic locking function, i.e., the capture of a spring biased bolt in the retracted position, is well known in the art and commonly referred to as "holdback". Previously known holdback techniques and apparatus have been characterized by one or more deficiencies, such deficiencies including mechanical complexity, difficulty of use and lack of reliability.

There are also circumstances where the occupant of premises which are secured by means of a deadbolt type lock may be desirous of disabling the outside operator, typically a key-operated cylinder, so that the bolt may not be withdrawn from the extended and locked position. The conditioning of a lock such that it may not be operated by an outside operator is also known in the art and commonly referred to as "lockout". Previously known lockout techniques and apparatus have, like previously known holdback techniques and apparatus, had inherent deficiencies. Further, the previously known holdback and lockout apparatus have not been embodied in a single, easily operable and reliable mechanism.

SUMMARY OF THE INVENTION

The present invention overcomes the above briefly discussed and other deficiencies and disadvantages of the prior art by providing a novel method and apparatus for accomplishing the selective holdback of a spring loaded lock bolt, and particularly the bolt of an automatic deadbolt lock. Apparatus in accordance with the present invention is characterized by the ability to easily and reliably capture a bolt in the retracted position, against the force of a spring, thus enabling the user of the lock to select either an automatic bolting mode or a holdback unlocked mode.

The present invention also provides a novel method and apparatus for accomplishing the selective lockout of an automatic deadbolt lock or other spring loaded lock bolt. Thus, apparatus in accordance with a preferred embodiment of the invention is characterized by the ability to effectively disable an outside operator so as to prevent its use to retract an extended bolt.

Apparatus in accordance with the preferred embodiment of the invention comprises a novel and improved inside operator for a lock having a spring loaded bolt. This operator includes a telescopic shaft which extends between a handle, affixed to its outer end, and a coupling mechanism by which the shaft is connected to the bolt. This connection may be via an actuating mechanism which is part of the bolt subassembly. Regardless of how the coupling is achieved, the capture of the telescopic shaft of the operator against rotation will prevent movement of the bolt along its axis either in response to the bias of the bolt spring or in response to the rotation of an outside operator. The inside operator also includes a cylinder-type housing which receives, in a bore, the telescopic shaft. The housing is provided with at least a first pin receiving chamber which is in communication with the bore. An outer member of the shaft, to which the handle is affixed, is provided with a circumferential groove. This circumferential groove is provided with at least a first notch or cut-out in a side surface thereof. A pin disposed in the chamber in the housing engages this groove so as to permit rotational movement of the shaft member. Axial movement of the shaft member is permitted when the pin is aligned with the notch. When the pin is engaged in the notch, the shaft will be immobilized against rotation. The second member which defines the rotatable shaft of the operator is captured in the housing in such a manner as to be capable of rotational movement only. The two portions of the shaft are interconnected by, in a preferred embodiment, a tongue and groove arrangement and the amount of axial movement permitted when the pin is engaged in the notch in the circumferential groove in the first shaft member is insufficient to uncouple the tongue from the groove.

The location of the notch in the wall of the circumferential groove in the inside operator shaft outer portion will be selected to be commensurate with a desired operational mode. In a preferred embodiment, the position of the notch corresponds to both the holdback and lockout modes. If necessary or desirable, different notch locations can be employed for the holdback and lockout modes.

BRIEF DESCRIPTION OF THE DRAWINGS

The present invention may be better understood, and its numerous objects and advantages will become apparent to those skilled in art, by reference to the accompanying drawings wherein like reference numerals refer to like elements in the several figures and in which.

DESCRIPTION OF THE DISCLOSED EMBODIMENT

Figure 1:
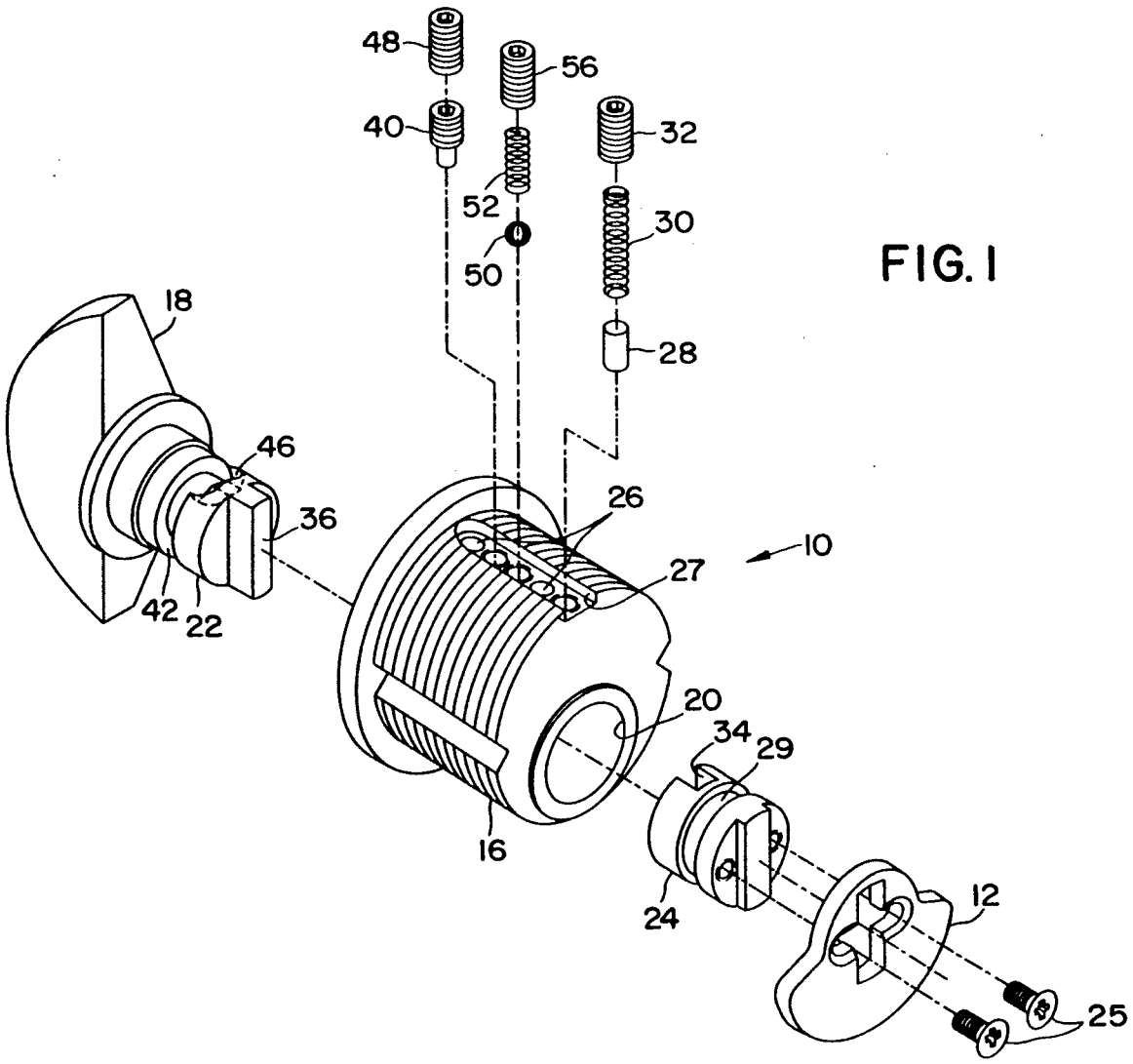
FIG. 1 is an exploded perspective view of a combination holdback and lockout mechanism in accordance with a first embodiment of the invention.

Apparatus in accordance with the present invention is particularly well suited for employment as the inside operator for an automatic deadbolt locking system. An automatic deadbolt is disclosed in co-pending application Ser. No. 560,423 and will not be further described herein. A locking system with which the present invention is employed will customarily have an outside operator which comprises a key operated cylinder. Both the inside and outside operators include rotatable members which are mechanically coupled to the bolt subassembly, the nature of the coupling mechanism being dictated by the construction of the bolt subassembly. The operators are capable of generation of a rotational force about an axis which is generally transverse to a vertical plane in which the axis of the installed bolt lies. These rotational forces are translated by the coupling mechanism into longitudinal bolt motion. Restated, the inside and outside operators are coupled to the bolt subassembly such that key or handle rotation will result in extension or retraction of the bolt. Referring to FIG. 1, in the disclosed embodiment of the invention the coupling mechanism of the inside operator, the operator being indicated generally at 10, is in the form of a rotatable cam 12. Referring to U.S. Pat. No. 4,272,974, because of the clear showing of a cam operated deadbolt, the cam 12 will engage a cam follower pin affixed to one end of a pivotal lever, the other end of the lever being attached to the bolt.

The inside operator 10 of the disclosed embodiment of the present invention comprises an externally threaded cylinder 16. Cylinder 16 threadably engages a housing, not shown, which may be seen by reference to U.S. Pat. No. 4,272,974. The operator 10 also includes a handle 18 which has a telescoping shaft extending therefrom. This shaft, which is rotatably received in a cylindrical bore 20 provided in cylinder 16, includes a first portion 22 which is integral with handle 18. The shaft also includes a second portion 24 which is coupled to shaft 22 in the manner to be described below. As will also be described below, shaft portion 22 is axially movable, i.e., movable along the axis of bore 20, with respect to shaft portion 24. The cam 12 is, as shown in FIG. 1, affixed to the shaft portion 24 by means of fasteners 25 and thus is rotatable by means of handle 18.

The cylinder 16 is provided with a linear array of threaded bores or chambers, indicated at 26, which intersect the cylindrical bore 20, the axes of these chambers being transverse to the axis of bore 20. The outer ends of the chambers 26 are situated at the base of a slot 27 provided in the threaded exterior of cylinder 16. Accordingly, the ends of set screws which are received in the chambers 26 will be recessed below the level of the bottoms of the grooves of the external thread on cylinder 16. The rearwardly disposed shaft portion 24 is captured in bore 20 by a pin 28. Pin 28 in the disclosed embodiment, is received in the most rearwardly disposed of the chambers 26 in cylinder 16. Pin 28 engages a circumferential groove 29 provided in shaft portion 24. The pin 28 is loaded, by means of a spring 30, against the base of groove 29. The spring 30 and pin 28 are captured in the chamber in cylinder 16 by means of a set screw 32.

Shaft portion 24 is provided, at the end disposed oppositely to cam 12, with a recess or slot 34. In the disclosed embodiment, slot 34 is slidably engaged by a complementary shaped projection 36 on the inwardly disposed end of shaft portion 22. The relationship between slot 34 and projection 36 permits longitudinal movement, limited in the manner to be described below, between shaft portions 22 and 24 while insuring that any rotational motion which is imparted to shaft portion 22 by handle 18 is directly coupled to shaft portion 24.

Shaft portion 22 is retained in bore 20 in cylinder 16 by a stepped pin 40 which is received, and supported on a shoulder, in another of the transversely oriented chambers 26 in the cylinder. The end of the smaller diameter portion of pin 40 is received in a circumferential groove 42 provided in shaft portion 22. The wall of groove 42 which is disposed away from and facing handle 18 is provided with a pair of notches 44 and 46 for the purposes to be described below. In the disclosed embodiment the notches 44 and 46 are offset along the circumference of groove 42 by 180°. Only notch 46, which is larger than notch 44, may be seen in FIG. 1, while both notches may be seen in FIGS. 3-5. The stepped pin 40 is retained in the chamber in cylinder 16 by a further set screw 48.

The operator of the disclosed embodiment of the invention is completed by a ball 50 which is loaded, by means of a spring 52, against the outer circumference of shaft portion 22. The circumferential portion of shaft 22 contacted by ball 50 is provided with a detent 54, which may best be seen from FIGS. 3 and 4, into which the ball 50 will drop. The function of the spring loaded ball is to provide tactile feedback to the user which indicates when the actuator is in the "home" position. The spring 52 and ball 50 are retained in a third of the transverse chambers 26 provided in cylinder 16 by means of further set screw 56.

Figure 2:
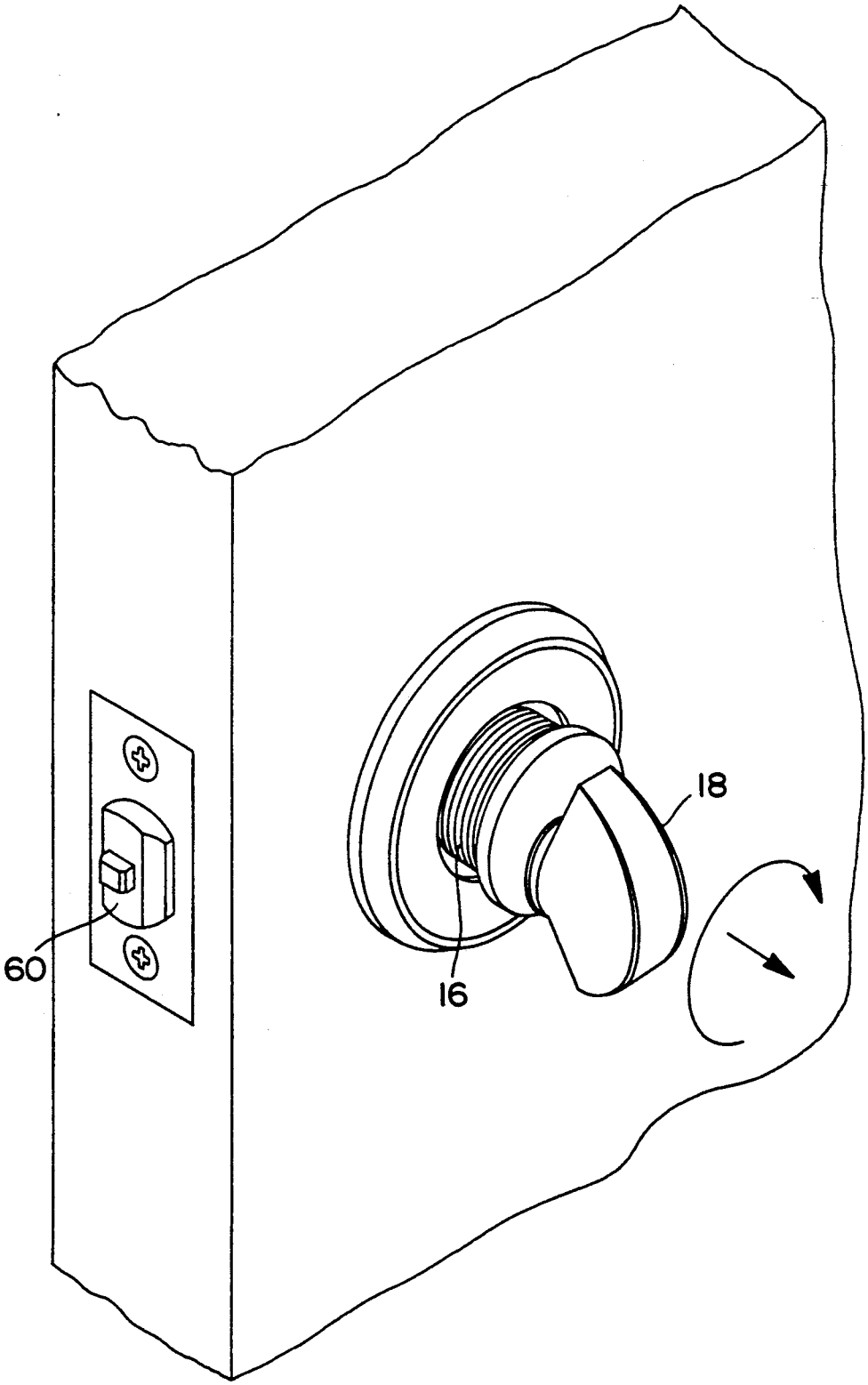
FIG. 2 is a perspective view depicting installation of the apparatus of FIG. 1 in an automatic deadbolt locking system.
Figure 3:
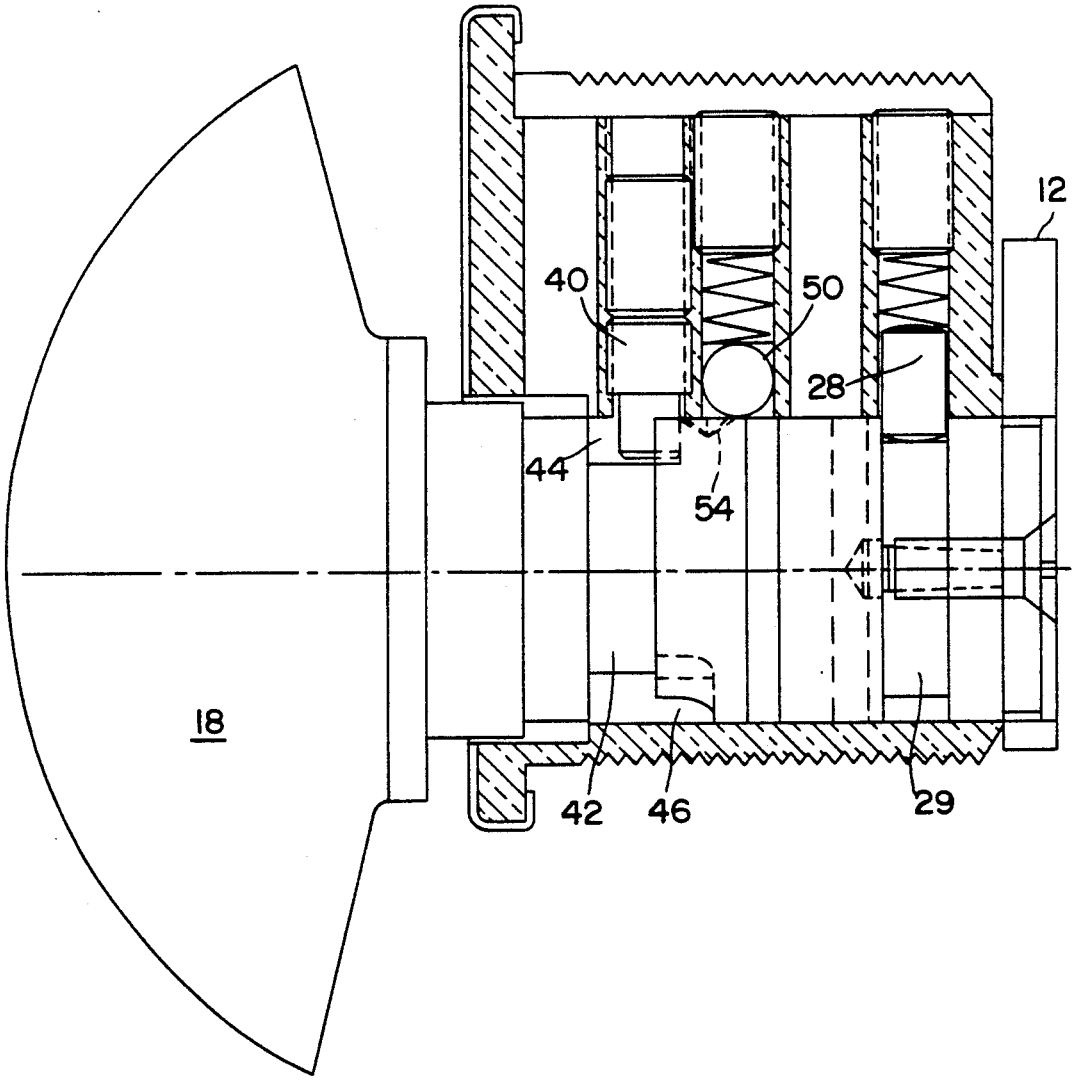
FIG. 3 is a partial cross-sectional, side elevation view depicting the apparatus of FIG. 1 during the installation procedure depicted in FIG. 2.
Figure 4:
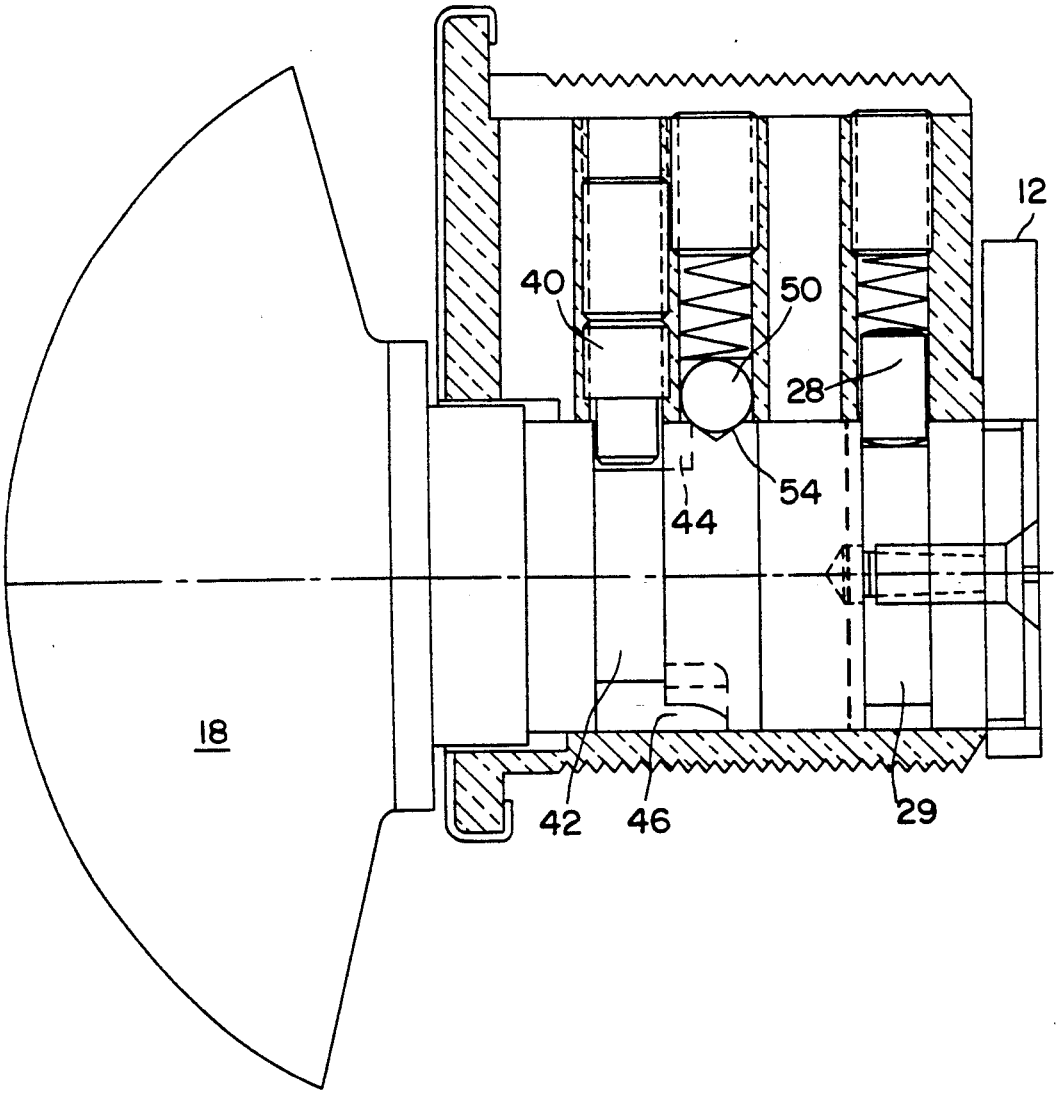
FIG. 4 is a view similar to FIG. 3 showing the apparatus of FIG. 1 in the normal operating position.

Referring now to FIGS. 2 and 3, the actuator of the disclosed embodiment of the invention is installed in a door by first rotating the handle 18, and thus the shaft 22/24, until the home position is reached as indicated by the ball 50 dropping into the detent 54 (see FIG. 4). At this time the stepped pin 40 will be in alignment with the notch extension 44 of the groove 42. Accordingly, the handle 18 may be pulled outwardly thus causing the pin 42 to move into the notch 44 and separating the base of the projection 36 from the base of the slot 34 (see FIG. 3). The entire actuator assembly may now be screwed into the lock housing, not shown, as a single piece by rotating the handle 18. The rotational force applied to handle 18 will be delivered to cylinder 16 via the contact between a side wall of notch 44 and the stepped pin 40. It is to be noted that the lock with which the operator is associated is depicted in FIG. 2 with its bolt 60 in the partially retracted or armed condition.

Figure 7:
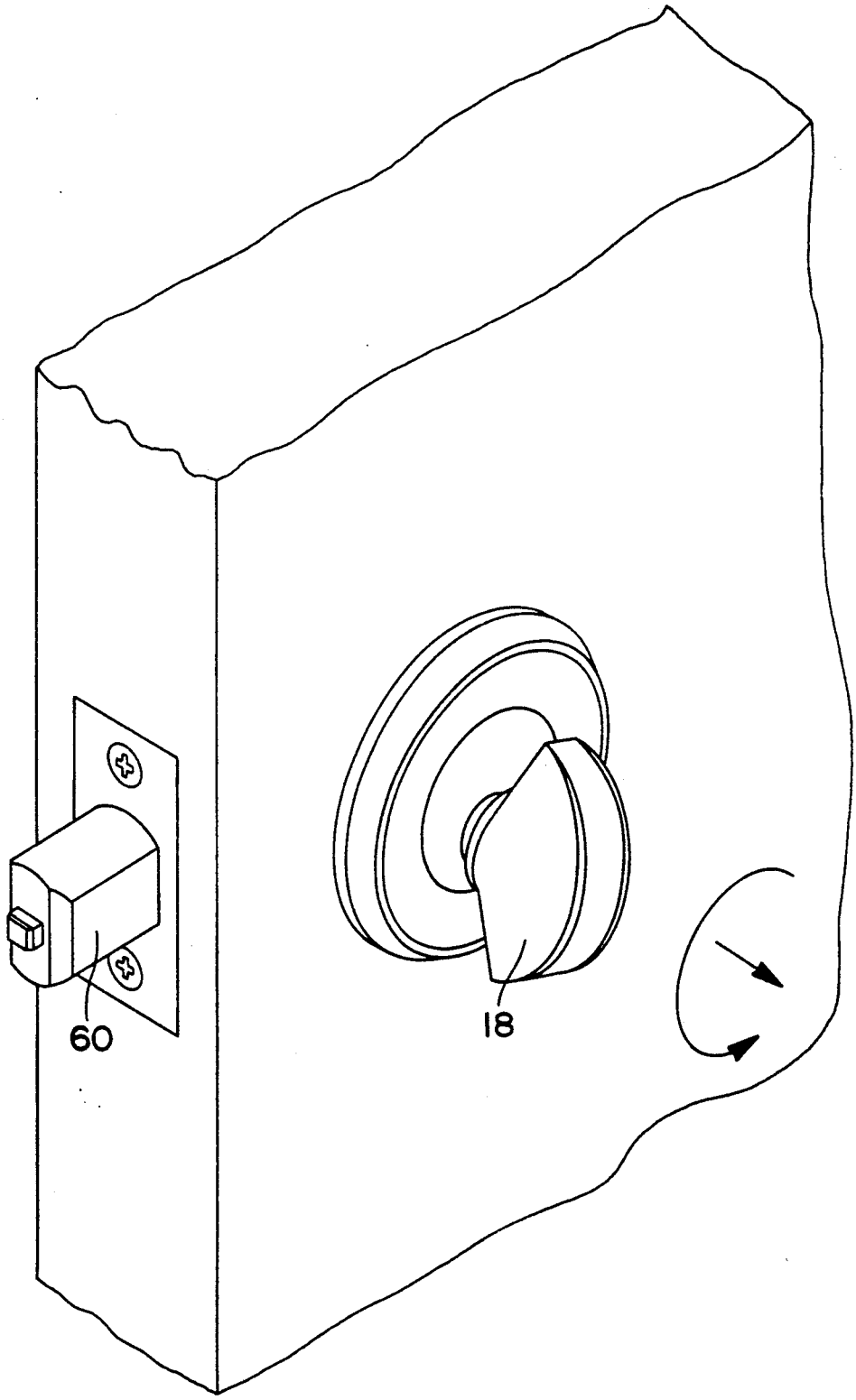
FIG. 7 is a view similar to FIG. 6 showing the locking system when the lockout mode has bee selected.

Referring now to FIG. 4, during normal operation the handle 18 will be pushed inwardly and the stepped pin 40 will ride in the groove 42 during rotation of handle 18 to cause bolt retraction or to cause an armed bolt to extend to the dead locked position. Also during normal operation, the retaining pin 28 will ride in the groove 29 and the ball 50 will ride on an outside cylindrical surface of shaft portion 22, i.e., a cylindrical surface disposed outwardly with respect to the base of the groove 42, and will drop into the detent 54 to indicate the home position. Rotation of the handle 18 will be transmitted, via the coupled shaft portions 22 and 24, to the cam 12 and thence to the bolt subassembly. When the actuator is employed with a spring loaded deadbolt, as disclosed in referenced U.S. patent application Ser. No. 560,423, the manual rotation of handle 18 will be employed to retract the bolt from either the fully extended and locked position, in which the bolt 60 is depicted in FIG. 7, or to release the bolt from the partially retracted position of FIG. 2.

Figure 5:
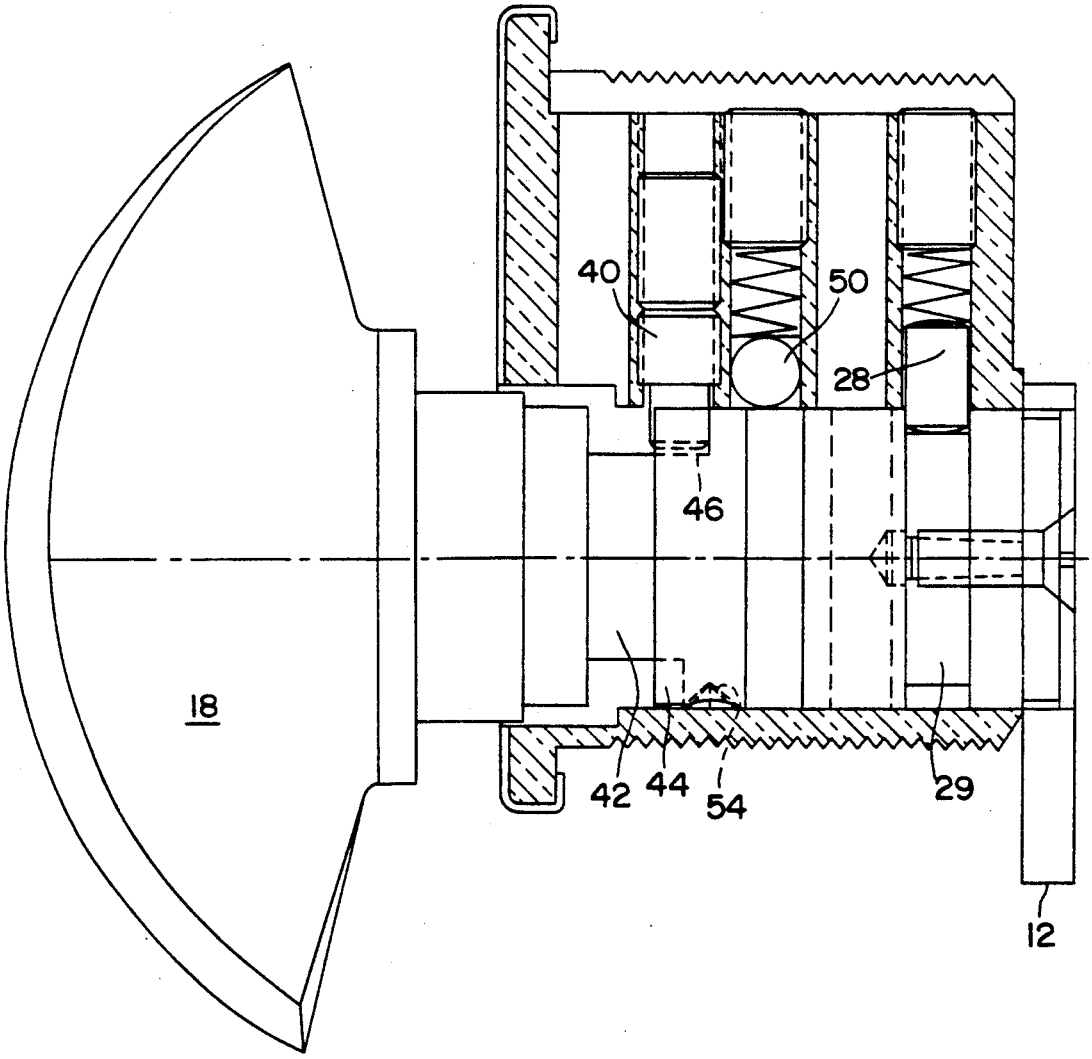
FIG. 5 is a view similar to FIG. 4 showing the apparatus in both the holdback and lockout operational modes.

In order to select either the holdback or lockout mode, the handle 18 is rotated, either clockwise or counterclockwise as appropriate, to align the stepped pin 40 with the notch 46 in the inwardly disposed wall of groove 42. The handle 18 is then pulled outwardly to engage pin 40 in notch 46. With the operator in this condition, as depicted in FIG. 5, the shaft 22, 24 cannot be rotated because of interference between pin 40 and the side wall of notch 46. Thus, contact between the pin 40 and one side of the notch 46 will prevent a bolt which has been fully retracted, as a result of counterclockwise rotation of handle 18, from being extended under the influence of the bolt spring. Similarly, contact between the pin 40 and the other side of the notch 46 will prevent movement from being imparted to a fully extended bolt by a key inserted in an outside operator, i.e., the locking of the shaft 22, 24 against rotation will, through the cooperation between the immobilized cam member 12 and the bolt lever, prevent an outside operator from causing the lever to pivot. All that is required to disengage the holdback or lockout mode is to push the handle 18 inwardly.

Figure 6:
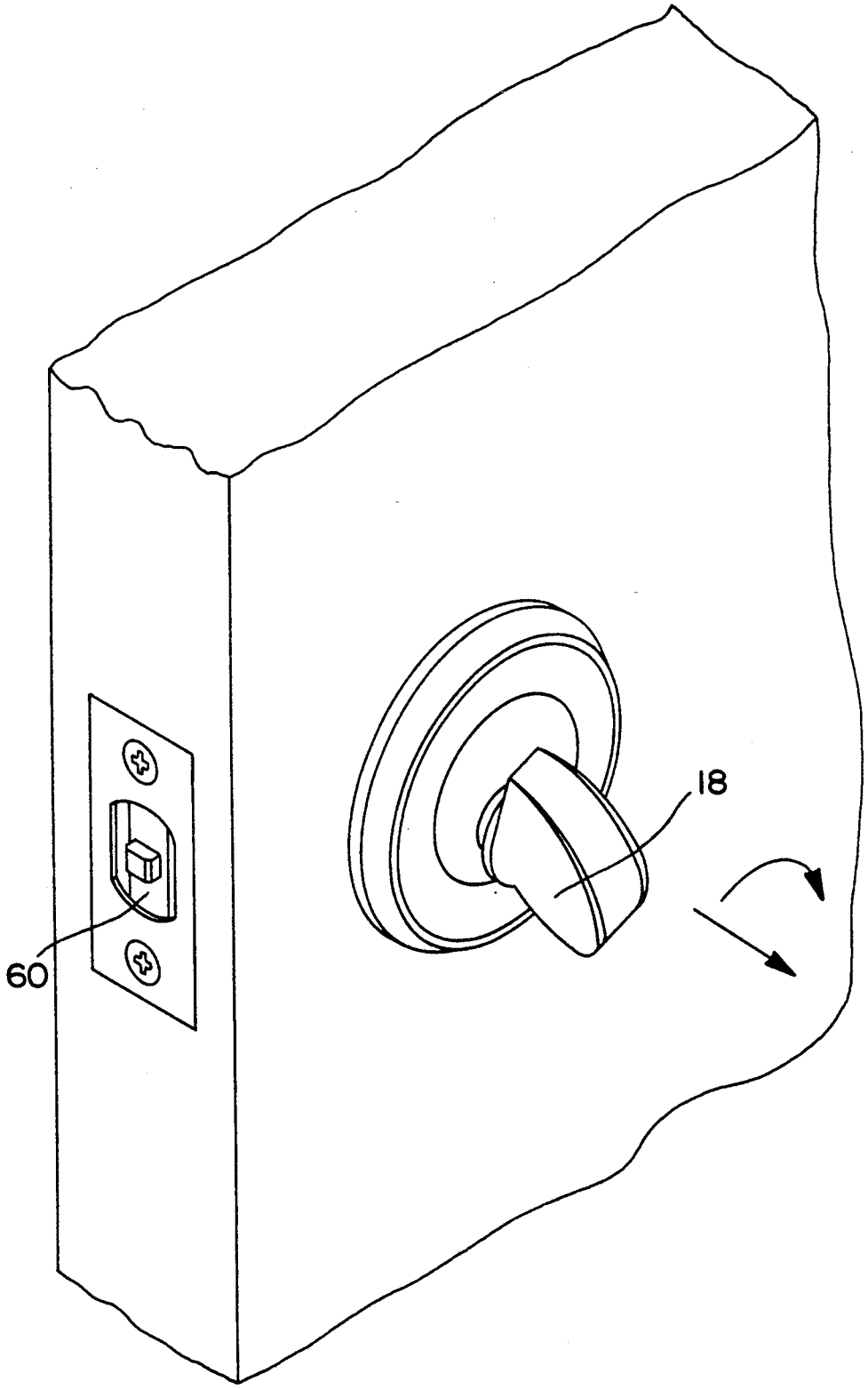
FIG. 6 is a view similar to FIG. 2 showing the locking system when the holdback mode is selected.

FIG. 6 depicts, through the use of arrows, the implementation of the holdback mode and shows the bolt 60 in the fully retracted position. FIG. 7, also through the use of arrows, depicts implementation of the lockout mode and shows the bolt 60 in the fully extended position.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a locking system, the locking system including a reciprocally movable bolt and a spring which biases the bolt toward an extended position, an improved operator comprising:

shaft means, said shaft means comprising a rotatable telescopic shaft including at least a pair of coaxial members which are rotatably coupled together at first ends thereof, said members being relatively movable in the axial direction;

handle means for imparting rotation to said shaft means, said handle means being affixed to a second end of a first of said members;

means for transmitting rotational movement of said shaft means to the bolt, said movement transmitting means being coupled to the second end of the other of said members;

cylinder means for defining a housing for said shaft means, said cylinder means having a bore therethrough, said bore having an axis, said shaft means extending through said bore and being coaxial therewith;

guide means for coupling said other of said shaft means members to said cylinder means, said guide means permitting rotational movement of said other member while preventing axial movement thereof whereby said other of said members will be permanently coupled to the bolt via said coupling means when the operator is in the installed condition; and mode selector means for coupling said cylinder means to said shaft means first member, said selector means permitting limited axial movement of said first member relative to said second member between first and second positions, the permitted axial movement being insufficient to interrupt the coupling between said shaft means members, said selector means also permitting rotation of said first member when in the first axial position and preventing rotation of said first member when in the second axial position whereby said shaft means may selectively be capable of rotation by said handle means or may be secured against rotation, reciprocal movement of the bolt being prevented by the securing of said shaft means first member against rotation.

2. The apparatus of claim 1 wherein said selector means captures said shaft means first member against rotation at a first rotational position of said handle means and wherein said operator may be selectively caused to assume a normal rotational mode of operation and a secured mode of operation by imparting longitudinal force to said handle means, said force being directed along said axis, when said handle means is in said first rotatable position.

3. The apparatus of claim 2 wherein said cylinder means is provided with at least a first chamber having an axis which is oriented generally transversely with respect to the axis of said bore, and wherein said selector means comprises:

a circumferential groove in the outer surface of said shaft means first member, said groove being provided with a recess in a first side surface thereof in a region commensurate with said handle means first position; and first pin means disposed in said cylinder means first chamber and extending into said groove in said shaft means first member, said first pin means being selectively caused to engage or disengage from said recess by said application of longitudinal force to said handle means.

4. The apparatus of claim 3 wherein said guide means comprises:

a second chamber in said cylinder means, said second chamber having an axis which is oriented generally transversely with respect to the axis of said bore;

a circumferential groove in said shaft means other member; and second pin means disposed in said second chamber, said second pin means engaging said groove in said second member.

5. The apparatus of claim 4 wherein at least a first of said shaft means members is provided with a recess in the first end thereof, side wall, and wherein the second of said shaft means members is provided with a projection extending from the first end thereof, said projection being complementary in shape to said recess in said first end of said first of said shaft means members, said shaft means members being coupled together by cooperation between said projection and recess.

6. The apparatus of claim 3 wherein said selector means first pin means comprises a stepped pin and wherein said cylinder means chamber which receives said stepped pin defines a shoulder for engaging and supporting said stepped pin.

7. The apparatus of claim 4 wherein said guide means second pin means is resiliently biased against the base of said circumferential groove in said shaft means other member.

8. The apparatus of claim 5 wherein said selector means first pin means comprises a stepped pin and wherein said cylinder means chamber which receives said stepped pin defines a shoulder for engaging and supporting said stepped pin.

9. The apparatus of claim 8 wherein said guide means second pin means is resiliently biased against the base of said circumferential groove in said shaft means other member.

* * * * *